US006863325B1

(12) United States Patent
Mills

(10) Patent No.: US 6,863,325 B1
(45) Date of Patent: Mar. 8, 2005

(54) LIFTING DEVICE

(75) Inventor: Robert Arthur Mills, Chorley (GB)

(73) Assignee: Natsteel Engineering Pte. Ltd. (SG)

( * ) Notice: Subject to any disclaimer, the term of this patent is extended or adjusted under 35 U.S.C. 154(b) by 0 days.

(21) Appl. No.: 10/204,940

(22) PCT Filed: Feb. 25, 2000

(86) PCT No.: PCT/SG00/00030

§ 371 (c)(1),
(2), (4) Date: Dec. 19, 2002

(87) PCT Pub. No.: WO01/62657

PCT Pub. Date: Aug. 30, 2001

(51) Int. Cl.[7] ..... B66C 1/66
(52) U.S. Cl. ..... 294/81.21; 294/81.53
(58) Field of Search ..... 294/81.1, 81.2, 294/81.21, 81.53, 67.1, 67.33

(56) References Cited

U.S. PATENT DOCUMENTS

| | | | | | |
|---|---|---|---|---|---|
| 3,709,543 | A | * | 1/1973 | Tax et al. | 294/81.2 |
| 3,863,970 | A | * | 2/1975 | Gottlieb et al. | 294/81.21 |
| 5,280,980 | A | * | 1/1994 | Coatta | 294/81.1 |

FOREIGN PATENT DOCUMENTS

| | | |
|---|---|---|
| DE | 19516520 | 11/1996 |
| WO | 97/39973 | 10/1997 |
| WO | 99/29613 | 6/1999 |

* cited by examiner

*Primary Examiner*—Dean J. Kramer
(74) *Attorney, Agent, or Firm*—Ostrolenk, Faber, Gerb & Soffen, LLP

(57) ABSTRACT

A lifting device (1) for goods containers (35) includes a body member (2). Four inner pickup elements (7, 8, 9, 10) are movably mounted on the body member (2). Two first extendable members (3, 4) are movably mounted on the body member (2) for movement between a first position in which the first extendable members (3, 4) are not extended from the body member (2) and a second position in which the first extendable members (3, 4) extend from opposite ends of the body member (2). Two second extendable members (5, 6) are provided with one second extendable member (5, 6) being mounted on each of the first extendable members (3, 4). Each second extendable member (5, 6) is movably mounted on the respective first extendable member (3, 4) for movement between a first position in which the second extendable member (5, 6) is not extended from the first extendable member (3, 4) and a second position in which the second extendable member (5, 6) is extended from the first extendable member (3, 4). Each second extendable member (5, 6) has two outer pickup elements (17, 18, 19, 20) mounted adjacent the end furthest from the body member (2) when the second extendable member (5, 6) is in the second position. In addition, two of the inner pickup elements (7, 9) are fixedly coupled to ones of the first extendable members (3) for movement therewith and the other two inner pickup elements (8, 10) are fixedly coupled to the other of the first extendable members (4).

13 Claims, 7 Drawing Sheets

LIFTING DEVICE

The invention relates to a lifting device, and for example, a lifting device for lifting freight containers.

Lifting devices for lifting freight containers generally comprise a metal frame (commonly known as a "spreader") attached to a hoist. The spreader is lowered by the hoist onto the top surface of the container and engages with the container at each of its four corners. Conventional spreaders generally only lift a single container. The spreader engages with the container at each of the four corners using pickup elements known as twistlocks. Each twistlock locates in a hole on each corner of the container. After being located in the holes, the twistlocks are rotated to lock the container to be lifted to the spreader. The spreader can then be lifted by the hoist with the goods container attached. This enables the container to be transferred from one location to another location, such as between a dock and a ship or between two ground locations, such as from a storage position to a ground transportation vehicle.

In recent years twinlift spreaders have been developed which are capable of lifting two 20 feet containers in end-to-end relationship simultaneously. Such twinlift spreaders have a twistlock at each corner and four centrally mounted twistlocks so that one twistlock engages with a corresponding aperture in each corner of each container. However, one of the problems with conventional twinlift spreaders is that they can only be used to pickup containers if the containers are at a predetermined separation from each other which corresponds to the separation of the central twistlocks. If the separation is greater than or less than the predetermined separation, it is not possible for the twinlift spreader to pick up both containers, as it is not possible for all eight twistlocks to engage with the twistlock apertures in both containers simultaneously.

International (PCT) patent application No. WO 97139973 discloses an adjustable twinlift spreader in which the central twistlocks are movable relative to each other to permit two end-to-end containers to be lifted by the spreader without the spacing of the containers having to be a predetermined. Typically, the spacing may be upto 5 feet. However, one of the disadvantages of the spreader disclosed in WO 97/39973 is that it requires a mechanical locking mechanism to be activated and deactivated during use in order to couple and uncouple the central twistlocks to the corresponding outer twistlocks.

In accordance with the present invention, there is provided a lifting device comprising a body member; four inner pickup elements movably mounted on the body member; two first extendable members movably mounted on the body member for movement between a first position in which the first extendable members are not extended from the body member and a second position in which the first extendable members extend from opposite ends of the body member; two second extendable members, one second extendable member being mounted on each of the first extendable members, and each second extendable member being movably mounted on the respective first extendable member for movement between a first position in which the second extendable member is not extended from the first extendable member and a second position in which the second extendable member is extended from the first extendable member, each second extendable member having two outer pickup elements mounted adjacent the end furthest from the body member when the second extendable member is in the second position; wherein two of the inner pickup elements are fixedly coupled to one of the first extendable members for movement therewith and the other two inner pickup elements are fixedly coupled to the other of the first extendable members.

Typically, the inner pickup elements are fixedly coupled to the respective first extendable member by a link member. Preferably, the link member comprises an elongate member such as a rod, bar or any other suitable means which maintains a substantially constant position of the inner pickup elements relative to the respective first extendable member.

Preferably, the inner pickup elements are slidably mounted on the body member. Typically, the two inner pickup elements fixedly coupled to the same first extendable member are movably mounted on opposite sides of the body member. Typically, when the extendable members to which the inner pickup elements are fixedly coupled are in the first position, the inner pickup elements on each side of the body member are adjacent to each other, and when the first extendable members are in the second position, the inner pickup elements on each side of the body member are separated from each other.

Typically, the lifting device may also comprise a control system which controls movement of the first extendable members and the second extendable members such that movement of both of the first extendable members and both of the second extendable members is symmetrical with respect to a central axis of the body member.

However, alternatively, it is possible that movement of the first and second members may be asymmetric of the central axis of the body member. This would have the advantage of permitting an operator to position a container held between the outer pickup elements or two containers held between the outer pickup elements and the inner pickup elements asymmetrically with respect to the central axis of the body member.

Preferably, the inner pickup elements are movable between a lowered position in which they may be engaged with a container to be lifted and a raised position in which they will not engage with a container. This has the advantage that the lifting device may be used to lift a single container between both sets of outer pickup elements without the inner pickup elements interfering with the container to be lifted.

Typically, each of the first extendable members is movably coupled to the body member by a piston device which moves the first extendable member between the first and second positions. Alternatively, each of the first extendable members may be coupled to the body member by a chain drive mechanism or any other suitable actuation means.

Typically, each of the second extendable members is movably coupled to the first extendable member by a chain drive mechanism which may be activated to drive the second extendable member between the first and second positions. Alternatively, each of the second extendable members may be coupled to the respective first extendable member by a piston device or any other suitable actuation means.

Preferably, the inner and outer pickup elements comprise a projection which is adapted to engage an aperture in a container to be lifted. Typically, the projection is inserted into the aperture and then rotated relative to the aperture to lock the container to the pickup element. Typically, the projection comprises a non-cylindrical portion and the aperture is non-circular so that the projection may be inserted into the aperture but rotation of the projection relative to the aperture prevents the projection being withdrawn from the aperture. For example, the projection may be of the type commonly known as a "twistlock".

Alternatively, the pickup elements may each comprise a hook or any other suitable means for engaging with an appropriate formation on an article to be lifted.

An example of a lifting device in accordance with the invention will now be described with reference to the accompanying drawings, in which.

Figure 1:
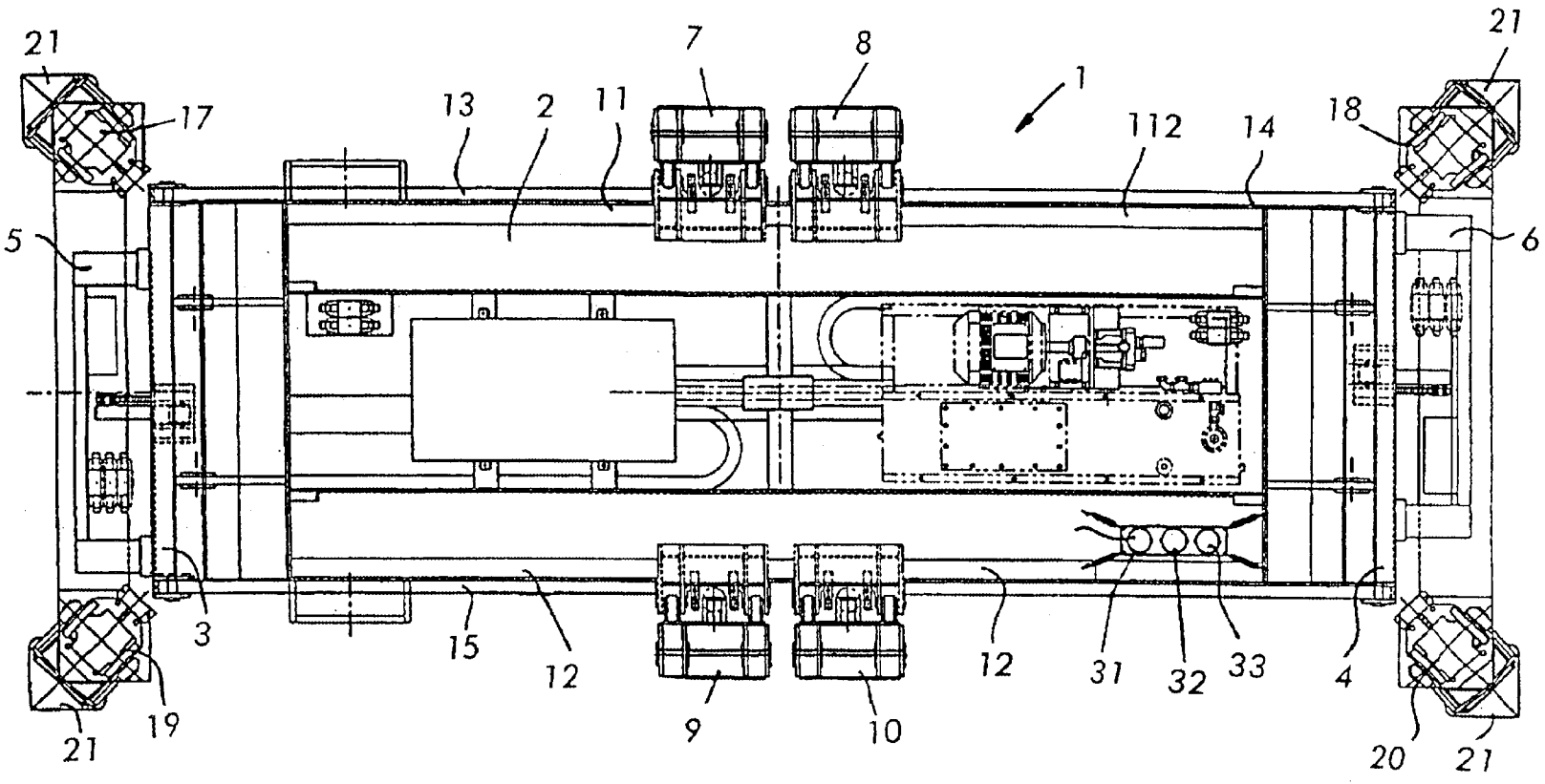
FIG. 1 is a plan view of a spreader with extendable members not extended.
Figure 2:
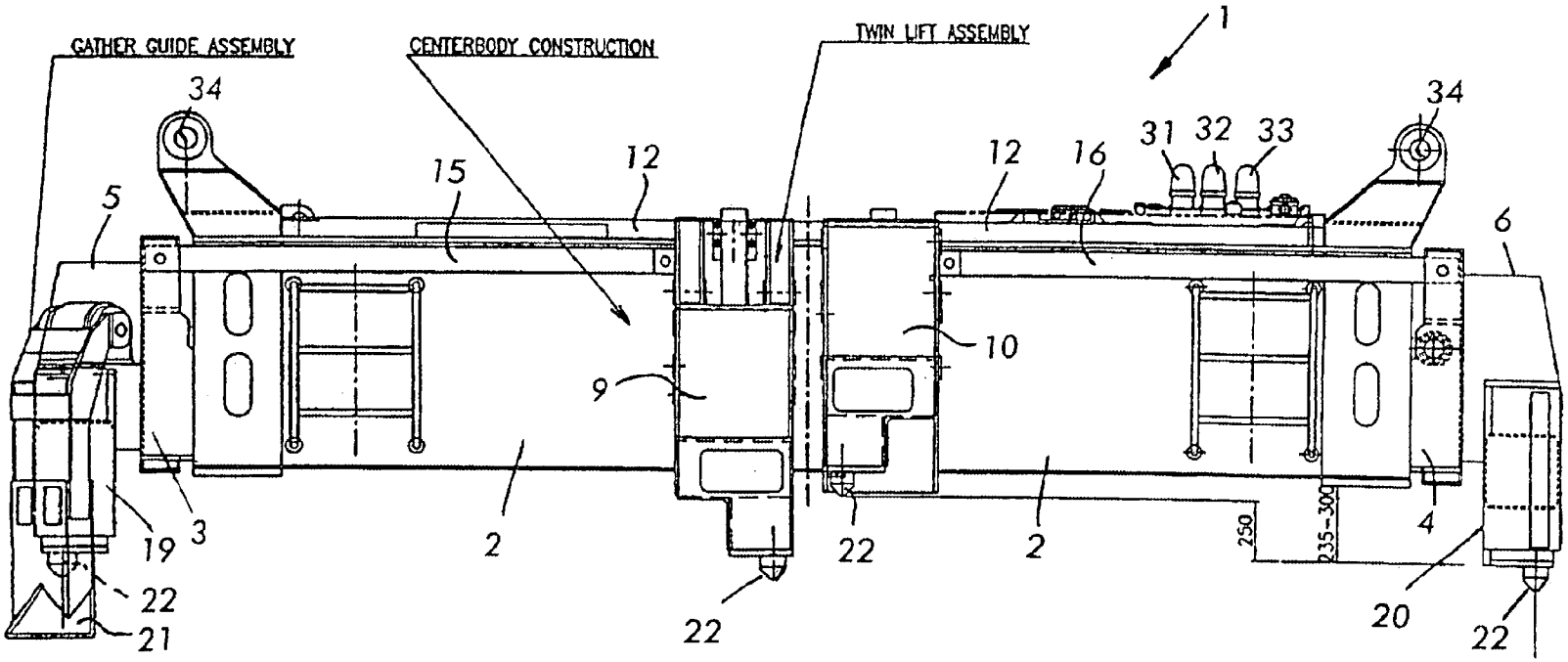
FIG. 2 is a side view of the spreader shown in FIG. 1.

FIGS. 1 and 2 show a spreader 1 which includes a body member 2, two first extendable members 3, 4 which extend from opposite ends of the body member 2 and two second extendable members 5, 6 which extend from each of the respective first members 3, 4. In the position shown in FIGS. 1 and 2, the first members 3,4 are not extended from the body member 2 and the second members 5, 6 are not extended from the first members 3, 4.

The body member 2 has four inner pickup elements 7, 8, 9, 10. The inner pickup elements 7, 8 are slidably mounted on the rail 11 on one side of the body member 2, and the inner pickup elements 9, 10 are slidably mounted on the rail 12 on the other side of the body member 2. In addition, the pickup elements 7, 9 are connected to the first member 3 by link rods 13, 15 respectively, and the inner pickup elements 8, 10 are connected to the first member 4 by link rods 14, 16 respectively. Hence, the pickup elements 7, 9 are fixed to the first member 3 and move with the first member 3, and the pickup elements 8, 10 are fixed to the first member 4 and move with the first member 4.

Located at the outer end of the second member 5 are two outer pickup elements 17, 19 and the outer end of the second member 6 has two outer pickup elements 18, 20. Each of the outer pickup elements 17, 18, 19, 20 also includes a locating device 21. The locating device 21 is not shown on the pickup element 20 in FIG. 2 for reasons of clarity. Each of the pickup elements 7, 8, 9,10, 17, 18, 19,20 includes a twistlock element 22 which can be engaged with an aperture in a corner of a container to be lifted and rotated to lock and unlock the container to the respective pickup element.

In addition, the inner pickup elements 7, 8, 9, 10 can be moved between a lowered position (shown by the position of the pickup element 9 in FIG. 2) and a raised position (shown by the pickup element 10 in FIG. 2).

The spreader 1 also includes three indicator lights, a green light 31, a white light 32 and a red light 33. These lights are used to indicate to an operator of the status of the spreader 1.

Figure 3:
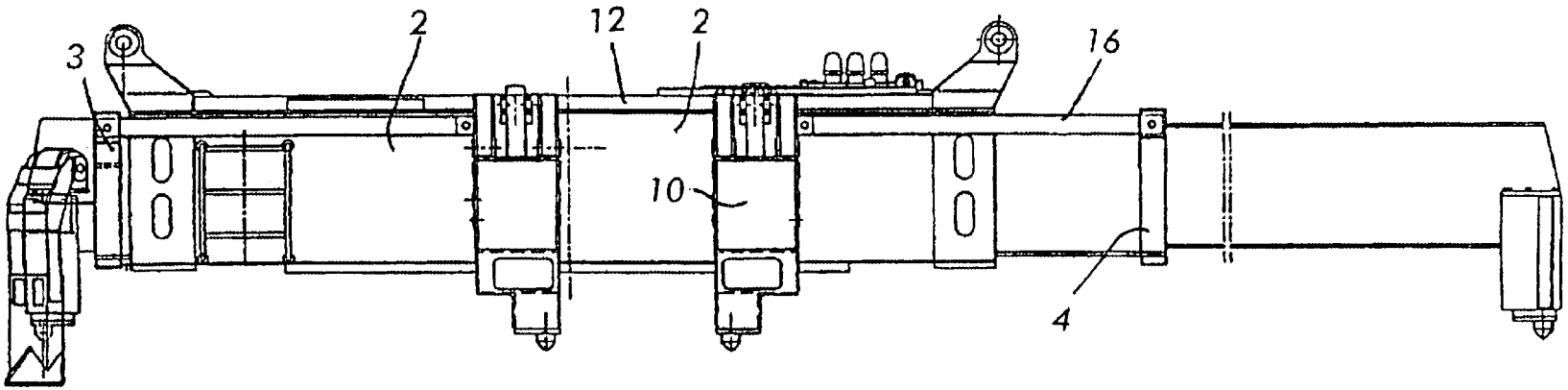
FIG. 3 is a side view of the spreader showing the right hand extendable members extended and the left hand extendable members not extended.
Figure 4:
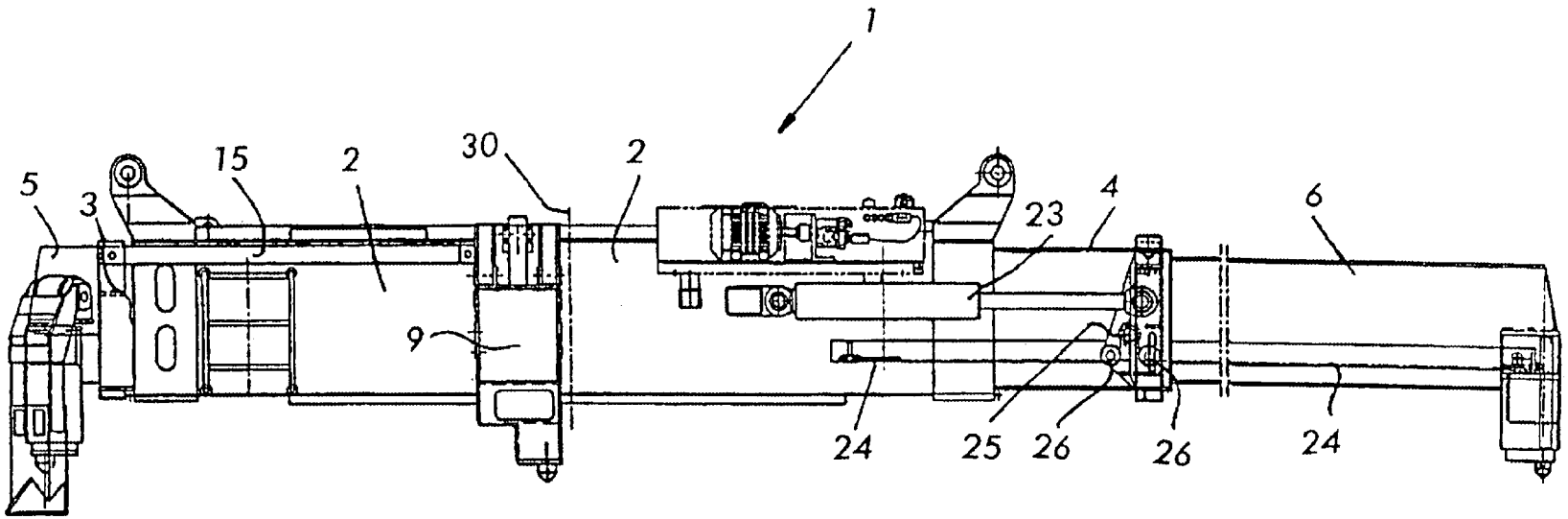
FIG. 4 is a partial cross-sectional view of FIG. 3.
Figure 5:
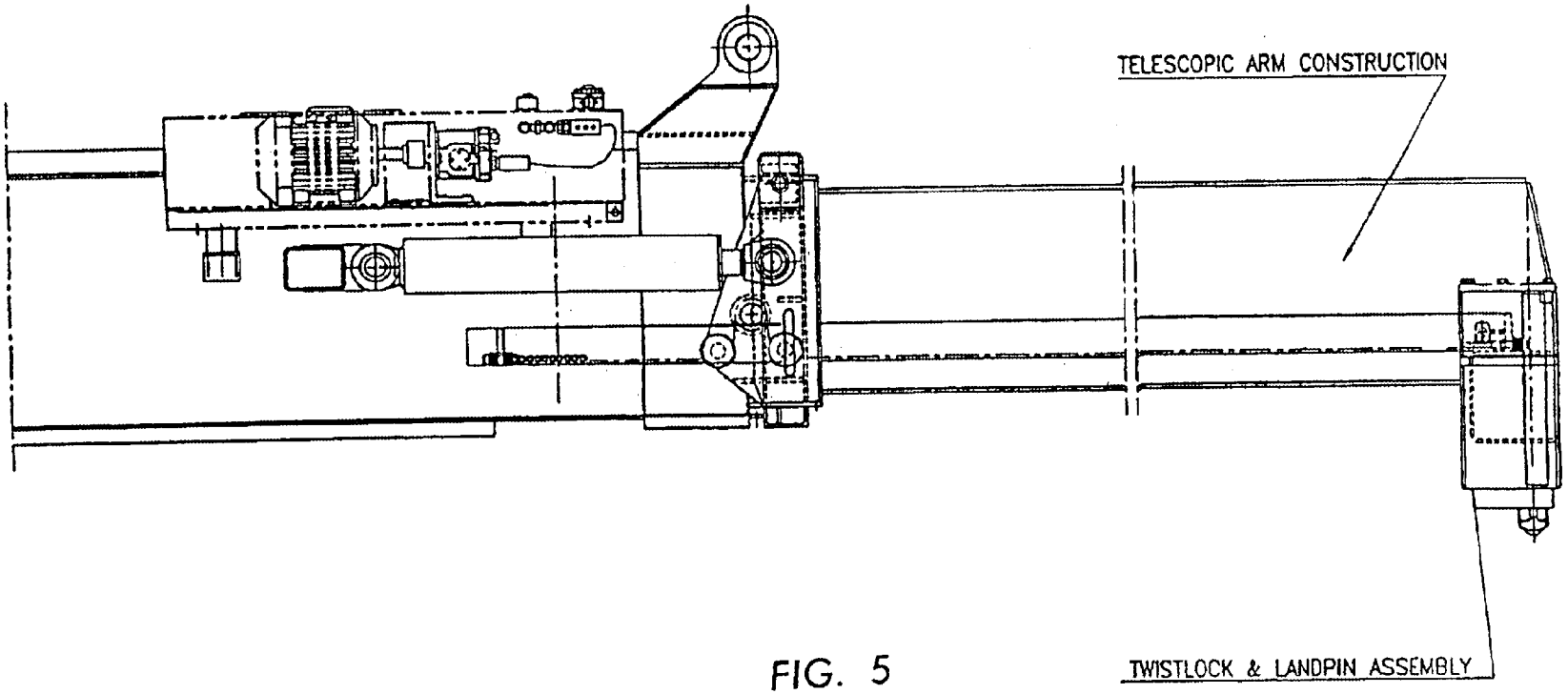
FIG. 5 is a cross-sectional view of the right hand half of the spreader showing a first member not extended and a second member extended.

As shown in FIG. 4, the first extendable member 4 is movably coupled to the body member 2 by a piston 23 which can be extended to the position shown in FIG. 4 to slide the first extendable member 4 out of the body member 2. A side view of the spreader 1 showing the first member 4 in the extended position is shown in FIG. 3. As shown in FIG. 3, the inner pickup element 10 is slid along the rail 12 towards the right hand end of the body member 2 by extension of the first extendable member 4 being fixed to the inner pickup element 10 by the link rod 16. Although not shown in FIG. 3 the inner pickup element 8 is also slid towards the right hand end of the body member on the rail 11 by extension of the member 4. FIG. 5 shows the piston 23 retracted and so the member 4 is not extended from the body member 2.

In a similar manner, the first extendable member 3 is coupled to the body member 2 by another piston (not shown) so that extension of the first extendable member 3 from the body member 2 moves the inner pickup elements 7, 9 along the rails 11, 12 respectively towards the left hand end of the body member 2.

The second extendable member 6 is coupled to the first extendable member 4 by a chain drive mechanism which comprises a chain 24 which extends along the length of the second extendable member 6 and which is entrained around a gear wheel 25 and two fly wheels 26. The gear wheel 25 and the fly wheels 26 are mounted on the first extendable member 4 and the gear wheel 25 is driven by a hydraulic motor (not shown) also mounted on the first extendable member 4. Hence, rotation of the gear wheel 25 causes the second extendable member 6 to slide in or out of the first extendable member 4 depending on the direction of rotation of the gear wheel 25. In a similar manner, the second extendable member 5 is coupled to the first extendable member 3 by another chain drive mechanism.

Although in FIGS. 3 and 4, the first extendable member 3 and the second extendable member 5 are shown retracted and the first extendable member 4 and the second extendable member 6 are shown extended, a control system (not shown) on the spreader 1 controls the extension and the retraction of the extendable members 3, 4, 5, 6 and would normally operate such that the first extendable members 3 4 are extended or retracted simultaneously and the second extendable members 5, 6 are extended or retracted simultaneously.

However, it is possible that the control system may be modified to permit asymmetric extension and retraction of the movable members 3, 4, 5. 6 to permit asymmetric positioning of a container (or containers) lifted by the is spreader 1 relative to central axis 30 of the body member 2.

Figure 6:
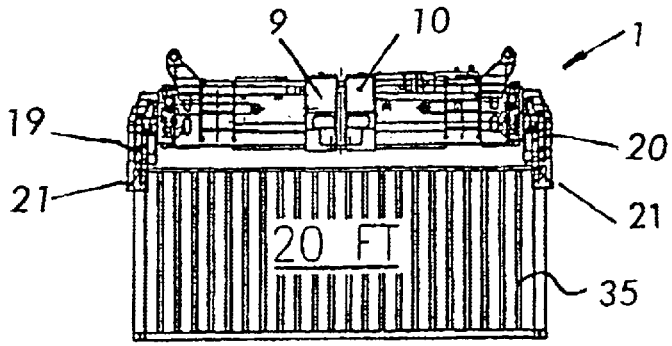
FIG. 6 shows a spreader engaged with a 20 feet container.

In use, the spreader would be coupled to a hoist using lifting holes 34. The hoist is used to lower the spreader 1 into engagement with a container and to lift both the spreader 1 and a container locked to the spreader 1. With both the first extendable members 3, 4 and the second extendable members 5, 6 retracted to the position shown in FIGS. 1 and 2, the spreader 1 may be engaged with a single 20 feet container, as shown in FIG. 6. Prior to lowering of the spreader 1 onto the container 35, the inner pickup elements 7, 8, 9, 10 are moved to the raised position. As the spreader 1 is lowered by the hoist, the locators 21 locate over the corners of the container 35 to aid positioning of the spreader 1 over the container 35 such that the twistlocks 22 engage in twistlock apertures in each of the four corners of the container 35.

When the green light 31 is illuminated this indicates to an operator that the twistlocks are in the unlocked position. When the spreader is landed on the container the white light 32 illuminates to indicate that the spreader has landed on the container 35. Therefore, when the operator sees the white light 32 illuminate, the operator actuates the twistlocks 22 to rotate them to the locked position. When the twistlocks 22 are in the locked position, the red light 33 illuminates. This indicates to the operator that the container 35 is secured to the spreader 1.

Figure 7:
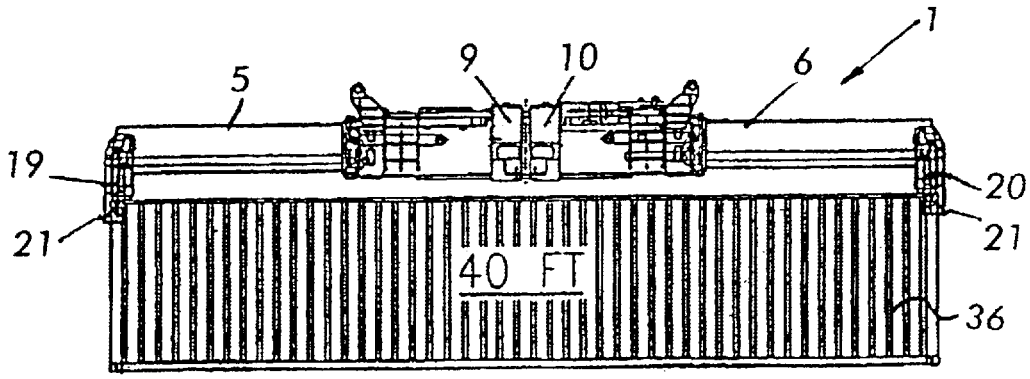
FIG. 7 shows the spreader engaged with a 40 feet container.

By extending the second extendable members 5, 6, maintaining the first extendable members 3, 4 in the non extended position and the inner pickup elements 7, 8, 9, 10 in the raised position, the spreader 1 can be used to pick up a single 40 feet container 36 as shown in FIG. 7.

Figure 8:
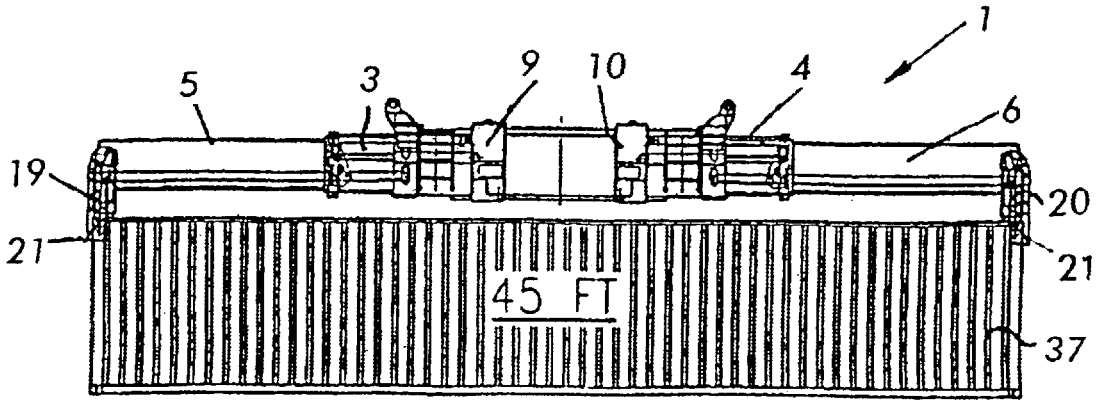
FIG. 8 shows the spreader engaged with a 45 feet container.

By also extending the first extendable sections 3, 4, the spreader 1 may be used to pick up a single 45 feet container 37, as shown in FIG. 8. FIG. 8 also shows how the inner pickup elements 9, 10 move to the separated position when the first extendable members 3, 4 are moved to the extended position by the pistons 23. The inner pickup elements 7, 8 on the other side of the body member 2 will also move to the separated position, simultaneously with the inner pickup elements 9, 10.

Figure 9:
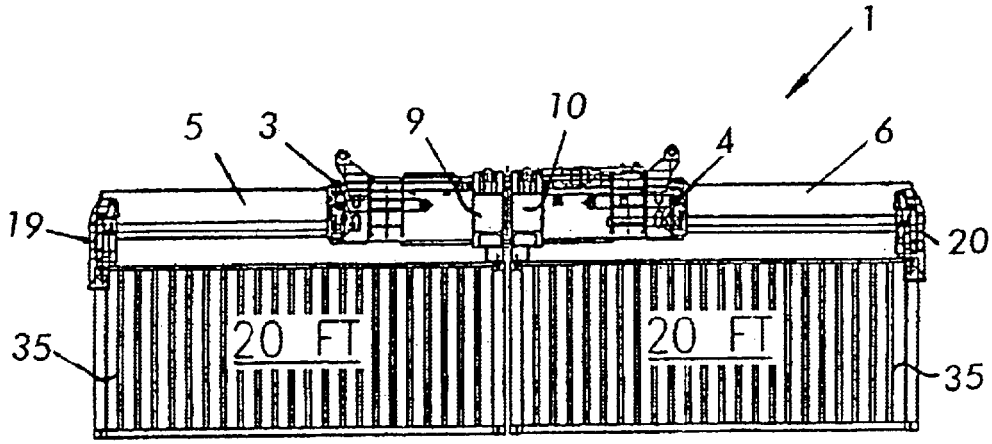
FIG. 9 shows the spreader engaged with two adjacent 20 feet containers.

If an operator wishes to pick up two adjacent 20 feet containers 35, as shown in FIG. 9, the second extendable members 5, 6 are extended and the first extendable members 3, 4 are moved to the non extended position, so that the inner pickup elements 7, 8, 9, 10 are adjacent to each other. In addition, the inner pickup elements 7, 8, 9, 10 are moved to the lowered position. Therefore, when an operator lowers the spreader 1 onto the containers 35, the outer pickup elements 17, 19 and the inner pickup elements 7, 9 engage with the left hand container 35 and the outer pickup elements 18, 20 and the inner pickup elements 8, 10 engage with the right hand container 35. When the twistlocks 22 are all inserted into the respective twistlock apertures on the tops of the containers 35, they are rotated to lock both the containers 35 to the respective pickup elements. Hence, when an operator lifts the spreader 1, the spreader 1 will lift both of the 20 feet containers 35.

If the operator then wishes to separate the two 20 feet containers 35 during the lifting operation so that they are positioned at the end of the lifting operation with their adjacent ends separated from each other, the operator can activate the control system to extend the first extendable members 3, 4. This extension of the first extendable members 3, 4 simultaneously moves the inner pickup elements 9, 10 away from the central axis 30 of the body member 2 and also moves the outer pickup elements 17, 18, 19, 20 by the same distance. This occurs automatically, without any locking mechanism being required to be activated to fix the inner pickup elements to the outer pickup elements. This causes the two 20 feet containers 35 to be moved to the position shown in FIG. 10 in which the adjacent ends of the two containers are separated from each other.

Figure 10:
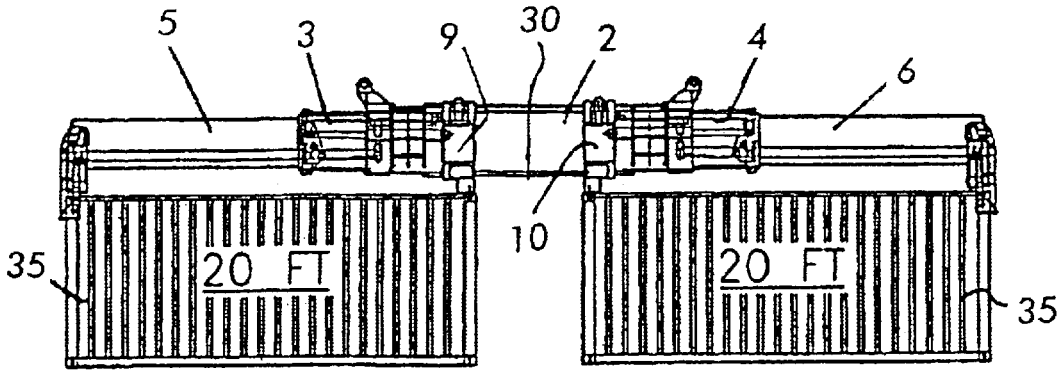
FIG. 10 shows the spreader engaged with two separated 20 feet containers.

Similarly, an operator can use the spreader 1 to pick up two separated containers 35, as shown in FIG. 10 and move the containers 35 until the facing ends are adjacent to each other, as shown in FIG. 9.

In addition, the first and second extendable members 3. 4, 5, 6 can be moved to intermediate positions to pick up containers of different sizes. Also, the spreader 1 may be designed with a longer body member 2, longer first extendable members 3, 4 and/or longer second extendable members 5, 6 to pick up containers which are longer than 45 feet.

Hence, the invention has the advantage that by using two extendable members on each side of the body member 2, it is possible to have an arrangement in which the respective inner pickup elements are fixed to one of the extendable members so that it is not necessary to have a mechanical locking and unlocking device to couple and uncouple the inner pickup elements to and from the outer pickup elements.

What is claimed is:

1. A lifting device comprising a body member; four inner pickup elements movably mounted on the body member; two first extendable members movably mounted on the body member for movement between a first position in which the first extendable members are not extended from the body member and a second position in which the first extendable members extend from opposite ends of the body member, two second extendable members, one second extendable member being mounted on each of the first extendable members, and each second extendable member being movably mounted on the respective first extendable member for movement between a first position in which the second extendable member is not extended from the first extendable member and a second position in which the second extendable member is extended from the first extendable member, each second extendable member having two outer pickup elements mounted adjacent the end furthest from the body member when the second extendable member is in the second position; wherein two of the inner pickup elements are fixedly coupled to one of the first extendable members for movement therewith and the other two inner pickup elements are fixedly coupled to the other of the first extendable members.

2. A lifting device according to claim 1, wherein each of the inner pickup elements are fixedly coupled to the respective first extendable member by a link member.

3. A lifting device according to claim 2, wherein the link members each comprise an elongate member, one end of each elongate member being connected to the respective first member and the other end connected to the respective inner pickup element.

4. A lifting device according to claim 1, wherein the inner pickup elements are slidably mounted on the body member.

5. A lifting device according to claim 1, wherein the two inner pickup elements fixedly coupled to the same first extendable member are movably mounted on opposite sides of the body member.

6. A lifting device according to claim 5, wherein the inner pickup elements on the same side of the body member are adjacent to each other when the first extendable members are in the first position, and are separated from each other when the first extendable members are in the second position.

7. A lifting device according to claim 1, further comprising a control system to control the movement of the first extendable members and the second extendable members.

8. A lifting device according to claim 7, wherein the control system controls the movement of the first extendable members and the second extendable members so that the movement is symmetrical with respect to a central axis of the body member.

9. A lifting device according to claim 7, wherein the control system can control the movement of the first extendable members and the second extendable members so that the movement is asymmetrical with respect to a central axis of the body member.

10. A lifting device according to claim 1, wherein the inner pickup elements are movable between a lowered position in which they may be engaged with a container to be lifted and a raised position.

11. A lifting device according to claim 1, wherein each of the first extendable members is movably coupled to the body member by a piston device which moves the first extendable member between the first and second positions.

12. A lifting device according to claim 1, wherein each of the second extendable members is movably coupled to the respective first extendable member by a chain drive mechanism which may be activated to drive the second extendable member between the first and second positions.

13. A lifting device according to claim 1, wherein the inner and outer pickup elements comprise a projection which is adapted to engage an aperture in a container to be lifted.

* * * * *